US009461397B2

(12) United States Patent
Feldmeier

(10) Patent No.: US 9,461,397 B2
(45) Date of Patent: Oct. 4, 2016

(54) HOUSING HAVING A SEAL

(71) Applicant: Tyco Electronics AMP GmbH, Bensheim (DE)

(72) Inventor: Guenter Feldmeier, Lorsch (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/378,320

(22) PCT Filed: Feb. 13, 2013

(86) PCT No.: PCT/EP2013/052816
§ 371 (c)(1),
(2) Date: Aug. 12, 2014

(87) PCT Pub. No.: WO2013/120870
PCT Pub. Date: Aug. 22, 2013

(65) Prior Publication Data

US 2015/0004814 A1 Jan. 1, 2015

(30) Foreign Application Priority Data

Feb. 14, 2012 (DE) ..... 10 2012 202 225

(51) Int. Cl.

| | |
|---|---|
| ***H01R 13/52*** | (2006.01) |
| ***H01R 13/6599*** | (2011.01) |
| ***H01R 13/648*** | (2006.01) |
| ***H01R 24/00*** | (2011.01) |
| *H01R 13/6584* | (2011.01) |
| *H01R 24/64* | (2011.01) |

(52) U.S. Cl.
CPC ..... *H01R 13/5219* (2013.01); *H01R 13/5216* (2013.01); *H01R 13/5221* (2013.01); *H01R 13/648* (2013.01); *H01R 13/6599* (2013.01); *H01R 24/00* (2013.01); *H01R 13/5205* (2013.01); *H01R 13/6584* (2013.01); *H01R 24/64* (2013.01); *H01R 2201/04* (2013.01)

(58) Field of Classification Search
CPC ..... H01R 13/6599; H01R 13/6584
USPC ..... 252/511; 439/89
See application file for complete search history.

(56) References Cited

U.S. PATENT DOCUMENTS

| | | | | | |
|---|---|---|---|---|---|
| 4,288,081 | A * | 9/1981 | Sado | H01B 3/004 | 174/358 |
| 4,448,837 | A * | 5/1984 | Ikeda | G06F 3/045 | 178/17 B |
| 4,583,809 | A * | 4/1986 | Werth | H01R 13/65802 | 439/585 |
| 4,593,962 | A * | 6/1986 | Knorreck | H01R 13/74 | 439/277 |
| 4,702,710 | A * | 10/1987 | Dittman | H01R 13/5205 | 439/125 |
| 4,703,989 | A * | 11/1987 | Price | A61B 5/0215 | 439/283 |

(Continued)

FOREIGN PATENT DOCUMENTS

| | | |
|---|---|---|
| EP | 0 158 076 A2 | 10/1985 |
| JP | 2000 340304 A | 12/2000 |

OTHER PUBLICATIONS

International Search Report and Written Opinion issued by the European Patent Office, dated Mar. 26, 2013, for related International Application No. PCT/EP2013/052816; 12 pages.

*Primary Examiner* — Ross Gushi
(74) *Attorney, Agent, or Firm* — Faegre Baker Daniels LLP

(57) ABSTRACT

The invention relates to a housing having a seal, the seal being formed from a resilient material, characterized in that the resilient material is electrically conductive.

11 Claims, 4 Drawing Sheets

(56) References Cited

U.S. PATENT DOCUMENTS 4,822,293 A * 4/1989 Robson ..... H01R 13/73 439/271
4,998,894 A * 3/1991 Gronvall ..... G02B 6/4447 439/133
5,093,037 A * 3/1992 Ohi ..... C08K 7/06 252/512
5,141,770 A * 8/1992 Benn, Sr. ..... F16J 15/064 427/380
5,297,971 A * 3/1994 Nitta ..... H01R 13/53 439/125
5,299,951 A * 4/1994 Blaetz ..... H01R 13/5208 439/367
5,334,044 A * 8/1994 Falossi ..... H01R 13/465 439/447
5,462,457 A * 10/1995 Schroepfer ..... H01R 13/5845 439/344
5,536,568 A * 7/1996 Teruo ..... C08L 83/04 252/502
5,564,948 A 10/1996 Harting et al.
5,564,951 A * 10/1996 Attal ..... A61B 5/021 29/858
5,631,443 A * 5/1997 Scrimpshire ..... G02B 6/3887 174/359
5,685,736 A * 11/1997 Lung ..... H01R 13/562 439/344
5,735,712 A 4/1998 Haas et al.
5,816,853 A * 10/1998 Buekers ..... G02B 6/4446 439/367
5,857,873 A * 1/1999 Castaldo ..... H01R 13/516 439/281
5,886,294 A * 3/1999 Scrimpshire ..... G02B 6/3887 174/359
5,949,029 A * 9/1999 Crotzer ..... B32B 27/08 174/254
6,007,378 A * 12/1999 Oeth ..... H01R 13/5213 439/279
6,080,001 A * 6/2000 Wong ..... H01R 13/6395 379/438
6,117,366 A * 9/2000 Park ..... H01B 1/22 252/512
6,162,087 A * 12/2000 Hiura ..... H01R 13/5213 174/152 G
6,238,599 B1 * 5/2001 Gelorme ..... H01B 1/22 252/512
6,241,398 B1 * 6/2001 Correa ..... G02B 6/3887 385/53
6,273,733 B1 * 8/2001 Uchiyama ..... H01T 13/04 439/125
6,322,386 B1 * 11/2001 Tharp ..... H01R 13/633 439/344
6,409,532 B2 * 6/2002 Payson ..... H01R 13/633 439/320
6,429,373 B1 * 8/2002 Scrimpshire ..... H02G 15/013 174/74 A
6,435,911 B1 * 8/2002 Payson ..... H01R 13/516 439/320
6,475,009 B2 * 11/2002 Below ..... H01R 24/64 439/271
6,482,017 B1 * 11/2002 Van Doorn ..... H01R 13/5213 439/149
6,524,121 B2 * 2/2003 Kanagawa ..... H01R 9/0518 439/95
6,558,180 B2 * 5/2003 Nishimoto ..... H01R 13/5221 439/271
6,582,248 B2 * 6/2003 Bachman ..... H01R 13/516 439/447
6,595,791 B2 * 7/2003 Below ..... H01R 24/64 439/271
6,624,383 B1 * 9/2003 Lichtenstein ..... B29C 70/545 219/121.67
6,652,289 B2 * 11/2003 Bae ..... H01R 13/623 439/34
6,887,105 B2 * 5/2005 Knighten ..... H01R 13/6596 439/607.24
7,018,226 B2 * 3/2006 Milner ..... H01R 13/5213 439/321
7,026,382 B2 * 4/2006 Akiba ..... H05K 3/321 252/512
7,074,066 B2 * 7/2006 Pepe ..... G02B 6/3807 439/271
7,083,436 B2 * 8/2006 Brodsky ..... B29C 45/0013 257/E23.067
7,101,212 B1 * 9/2006 Larkin ..... H01R 24/64 439/344
7,179,100 B2 * 2/2007 Montena ..... H01R 13/73 439/133
7,186,127 B2 * 3/2007 Montena ..... H01R 9/05 411/428
7,234,877 B2 * 6/2007 Sedor ..... G02B 6/3879 385/59
7,255,587 B2 * 8/2007 Boeck ..... H01R 13/6275 439/354
7,303,418 B2 * 12/2007 O'Connor ..... H01R 13/5208 439/277
7,351,361 B2 * 4/2008 Shimizu ..... H01B 1/02 156/327
7,402,063 B2 * 7/2008 Montena ..... H01R 9/05 439/271
7,435,126 B1 * 10/2008 Larkin ..... H01R 13/6272 439/352
7,484,896 B2 * 2/2009 DeCusatis ..... G02B 6/3887 385/53
7,510,439 B2 * 3/2009 Gordon ..... H01R 13/6589 439/607.41
7,632,141 B2 * 12/2009 Malak ..... H01R 13/5219 439/271
7,726,440 B2 * 6/2010 Aisenbrey ..... B29C 45/0013 174/388
7,758,360 B2 * 7/2010 Lesage ..... H01R 13/5213 439/135
7,767,908 B2 * 8/2010 Sylvan ..... F16L 5/10 174/72 A
7,771,221 B1 * 8/2010 Blackwell ..... H01R 13/52 439/282
7,824,205 B2 * 11/2010 Scislak ..... H01R 13/6272 439/344
7,838,775 B2 * 11/2010 Montena ..... H01R 13/5213 174/138 F
7,854,620 B2 * 12/2010 Hughes ..... H01R 13/035 439/181
7,988,476 B2 * 8/2011 Billman ..... H01R 13/5202 439/271
8,062,045 B2 * 11/2011 Montena ..... H01R 13/5213 439/282
8,108,968 B2 * 2/2012 Pietryga ..... H02G 3/0468 16/2.1
8,109,776 B2 * 2/2012 Hughes ..... H01R 13/46 439/282
8,152,547 B2 * 4/2012 Hughes ..... H01R 13/46 439/282
8,337,228 B1 * 12/2012 Montena ..... H01R 13/5219 277/609
8,353,721 B2 * 1/2013 Deimel ..... H02G 3/22 439/607.41
8,419,467 B2 * 4/2013 Montena ..... H01R 13/5213 439/523
8,480,428 B1 * 7/2013 Sper ..... H01R 13/5213 439/521
8,529,288 B2 * 9/2013 Montena ..... H01R 13/5213 439/523
8,573,853 B2 * 11/2013 Ordo ..... H01R 13/506 385/53
8,628,252 B2 * 1/2014 Matsumoto ..... G02B 6/3879 385/56
8,672,705 B2 * 3/2014 Schneider ..... G02B 6/3887 439/460
8,764,480 B2 * 7/2014 Natoli ..... H01R 13/5213 439/523
8,808,580 B2 * 8/2014 Plee ..... B82Y 30/00 252/502
8,853,542 B2 * 10/2014 Anderson ..... H01R 13/5213 174/138 F

(56) References Cited

U.S. PATENT DOCUMENTS 8,975,004 B2 * 3/2015 Choi ..... C08F 2/44 252/500
9,048,573 B2 * 6/2015 Grzegorzewska ... H01R 13/508
2001/0036762 A1 * 11/2001 Payson ..... H01R 13/622 439/320
2002/0162672 A1 * 11/2002 Cook ..... H05K 9/009 174/391
2004/0203289 A1 10/2004 Ice et al.
2005/0042922 A1 * 2/2005 Haller ..... H01R 13/6599 439/607.01
2005/0064752 A1 * 3/2005 Serino ..... H01R 13/622 439/320
2005/0167189 A1 * 8/2005 Aisenbrey ..... G06K 19/07749 181/199
2005/0176294 A1 * 8/2005 Montena ..... H01R 9/05 439/587
2005/0183871 A1 * 8/2005 Hou ..... H05K 9/0083 174/388
2005/0215101 A1 * 9/2005 Pepe ..... G02B 6/3807 439/281
2006/0035508 A1 * 2/2006 Stekelenburg ..... H01R 13/6392 439/369
2006/0089049 A1 * 4/2006 Sedor ..... G02B 6/3879 439/620.21
2006/0216992 A1 * 9/2006 Hughes ..... H01R 13/53 439/607.01
2006/0286862 A1 * 12/2006 Lubinsky ..... H01R 4/12 439/521
2007/0018142 A1 * 1/2007 Kwon ..... B82Y 10/00 252/511
2007/0025665 A1 * 2/2007 Dean ..... G02B 6/3869 385/78
2007/0036489 A1 * 2/2007 Grzegorzewska ... H01R 13/508 385/88
2009/0202207 A1 * 8/2009 Grzegorzewska ... H01R 13/508 385/88
2009/0291608 A1 * 11/2009 Choi ..... H05K 9/0015 442/394
2010/0266242 A1 * 10/2010 Lu ..... G02B 6/3816 385/53
2011/0115494 A1 * 5/2011 Taylor ..... H01R 13/514 324/537
2012/0009830 A1 * 1/2012 Montena ..... H01R 13/5213 439/892
2012/0021631 A1 1/2012 Yi et al.
2012/0214335 A1 * 8/2012 Natoli ..... H01R 13/5213 439/519
2013/0039624 A1 * 2/2013 Scherer ..... H01R 9/032 385/92
2013/0115805 A1 * 5/2013 Montena ..... H01R 13/5213 439/521
2014/0141641 A1 * 5/2014 De Dios Martin .. H01R 13/633 439/358
2015/0004814 A1 * 1/2015 Feldmeier ..... H01R 13/5216 439/89

* cited by examiner

HOUSING HAVING A SEAL

BACKGROUND

The invention relates to a housing having a seal according to patent claim 1.

In the prior art, various embodiments of housings having seals are known, the seal being formed from a resilient material.

SUMMARY

An object of the invention is to provide an improved housing, in particular with regard to electrical shielding.

The object of the invention is achieved by the housing according to patent claim 1.

Other advantageous embodiments of the housing are set out in the dependent claims.

The object of the invention is achieved by the housing according to patent claim 1, a seal of the housing having a resilient electrically conductive material.

In this manner, the resilient material affords the possibility, on the one hand, of providing a seal against dust or fluids, and additionally of producing an electrically conductive connection. In particular, the electrically conductive resilient material can be used as a shield or as an electrically conductive connection between two housing portions or a housing portion and a cable.

In one embodiment, the resilient, electrically conductive material has a silica gel. The silica gel provides, on the one hand, good resilient properties and, on the other hand, a matrix for good electrical conductivity.

In another embodiment, the seal is produced from an admixture of a resilient material and an electrically conductive material. The electrically conductive material may preferably be carbon black and/or graphite.

In another embodiment, the seal is produced from an admixture of a resilient material and electrically conductive particles. The electrically conductive particles may, for example, be constructed in the form of metal particles, electrically conductive nanoparticles and/or graphite particles, in particular in the form of graphite tubes.

In another embodiment, an electrically conductive particle is constructed in the form of a particle having an electrically conductive layer. The particles can thereby be produced in a cost-effective manner. In addition, the weight is reduced compared with purely metal particles.

Using the electrically conductive material or the electrically conductive particles, it is possible to achieve a desired electrical conductivity of the seal together with good resilient properties of the seal.

In another embodiment, the seal acts as a radial and/or an axial seal with respect to another housing.

In another embodiment, the seal serves to seal an opening of the housing through which an electrical line is guided into the housing. Using the seal, it is possible to achieve, on the one hand, sealing with respect to dust or moisture and, on the other hand, to allow electrical contacting of an electrical shield of the line.

Owing to the resilient property of the seal, a secure and reliable contacting of the shielding of the line and a secure and reliable sealing with respect to dust and moisture is possible.

In another embodiment, the housing is constructed in the form of a connector housing, in particular in the form of a housing for an RJ-45 connector. The resilient and electrically conductive seal may advantageously be used in particular with connector housings.

In another embodiment, the housing is partially produced from an electrically conductive material. Consequently, the seal may be used as an electrical contact connection between the electrically conductive portion of the housing and a shield of an electrical line. In another embodiment, the seal may be constructed as an electrical shield.

Preferably, the seal and at least one portion of the housing is produced from the same material, in particular the seal and at least one portion of the housing are constructed in one piece. A secure electrical contacting between the seal and the electrical portion of the housing is thereby achieved. Furthermore, the production of the housing with the seal is simplified owing to the single-piece configuration.

BRIEF DESCRIPTION OF THE DRAWINGS

The invention is explained in greater detail with reference to the Figures, in which.

DETAILED DESCRIPTION

The invention is explained below with reference to the example of a housing for a connector. However, the invention is independent of the embodiment of the housing and can also be applied to any type of housing, such as, for example, a connector housing, connection housing, relay housing, etcetera.

Figure 1:
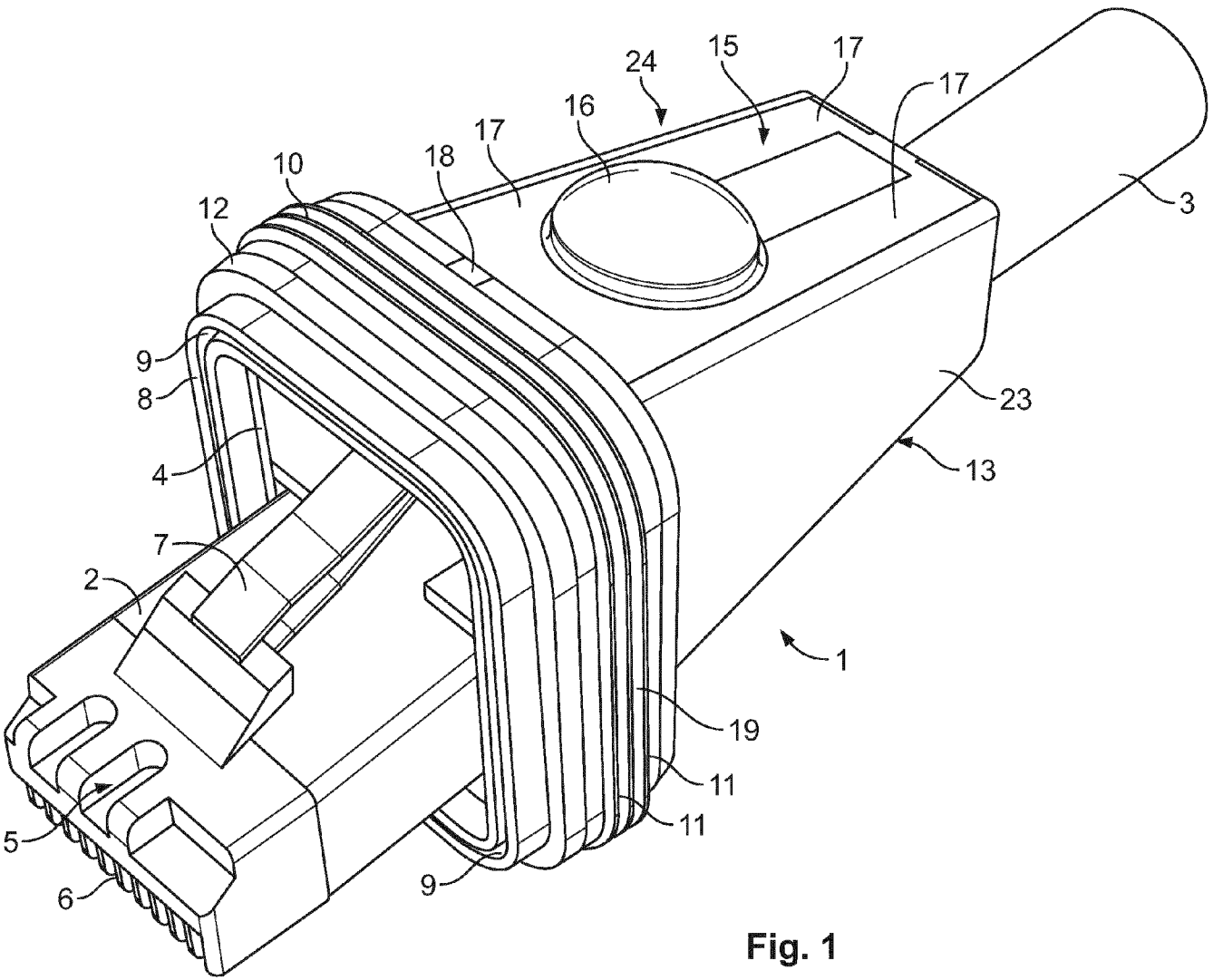
FIG. 1 is a perspective illustration of a connector having a housing.

FIG. 1 is a perspective view of a housing 1, in which a connector 2 is arranged. A cable 3 is guided through a rear side of the housing 1 to the connector 2. The housing has a front-side opening 4 through which a front side 5 of the connector 2 protrudes. Electrical contacts 6 are arranged at the front side 5 of the connector 2. Furthermore, the connector 2 has a flexible curved engaging member 7 which protrudes through the opening 4 into the housing 1. The opening 4 is delimited by a peripheral front-side edge region 8. The edge region 8 delimits the opening 4 and protrudes beyond the housing 1 in the direction of the front side 5 of the connector 2. The edge region 8 is produced in the illustrated embodiment from a resilient and electrically conductive material. The term resilient material is intended to be understood to refer to purely resilient materials and viscoelastic materials, that is to say, partially resilient and partially viscous materials. In the embodiment illustrated, the edge region 8 has at the front side a peripheral groove 9. Depending on the embodiment selected, the groove 9 may also be dispensed with. The groove 9 improves the sealing behaviour when the edge region 8 is in abutment against an associated abutment face.

Furthermore, the housing 1 has a second edge region 10 which is arranged so as to extend radially around the opening 4. The second edge region 10 protrudes peripherally in a radial direction beyond the housing 1. The second edge region 10 is preferably also produced from the electrical and resilient material. In the embodiment illustrated, the second edge region 10 has two second grooves 11. Depending on the embodiment selected, the second grooves 11 may also be dispensed with. The second grooves 11 improve the sealing behaviour of the second edge region 10 during abutment with an associated abutment face. In the embodiment illustrated, the first and second edge regions 8, 10 are constructed in two parts and spaced apart from each other by means of a peripheral housing ring 12. The second edge region 10 is recessed from the front side of the housing 1 with respect to the first edge region 8. Depending on the embodiment, the first and second edge regions 8, 10 may also be constructed in one piece in the form of a ring.

Depending on the embodiment selected, the first or second edge regions 8, 10 may be dispensed with. In addition, the first and the second edge regions 8, 10 may also comprise different materials, at least one of the edge regions 8, 10 comprising the resilient and electrically conductive material.

The resilient and electrically conductive material is produced, for example, from an admixture of a resilient material and an electrically conductive material. In particular, carbon black and/or graphite can be used as an electrically conductive material.

In another embodiment, the electrical and resilient material is produced from an admixture of a resilient material and electrically conductive particles. For example, metal particles, electrically conductive nanoparticles and/or graphite particles, in particular graphite tubes, can be used as electrically conductive particles. Depending on the embodiment selected, the electrically conductive function of the resilient material can also be achieved with an admixture of electrically conductive material and electrically conductive particles.

In another embodiment, an electrically conductive particle is constructed in the form of a particle having an electrically conductive layer. For example, a particle may comprise an electrically insulating material, for example, a ceramic or mineral material, whose surface is at least partially, preferably completely, provided with an electrically conductive layer, for example, a metal layer. For example, silver and/or gold and/or palladium can be used as the metal.

The electrically conductive material has, for example, a specific electrical volume resistance of up to 100 mΩcm.

The resilient material is, for example, a thermoplastic material, a thermoplastic gel, a gel based on polyurethane, a polymer, a silicone rubber, a silicone elastomer, a silica gel, in particular a dry silica gel.

The housing 1 has a main body 13 having a rear side 14 having an opening 22 through which the cable 3 is guided into the housing 1. In the embodiment illustrated, an upper side 15 of the main body 13 has an actuation element 16 in the form of a projection. The actuation element 16 serves to actuate the curved engaging member 7. In the illustrated embodiment, at least one portion of the upper side 15 of the main body 13 is covered with a layer 17 or formed from a layer 17. The layer 17 is preferably produced from the resilient and electrically conductive material. Depending on the selected embodiment, the layer 17 can be connected in an electrically conductive manner to the first and/or the second edge region 8, 10. Depending on the selected embodiment, the layer 17 may also be dispensed with. In the embodiment illustrated, the layer 17 is connected to the second edge region 10 by means of a connection piece 18. The connection piece 18 is preferably also produced from the electrical, resilient material. The second edge region 10 is formed in a peripheral groove of the housing 1 which is formed by the housing ring 12 and a second radially peripheral housing ring 19 which is spaced apart therefrom. The first and the second housing rings 12, 19 are arranged on the main body 13 and are constructed integrally with the main body 13.

Figure 2:
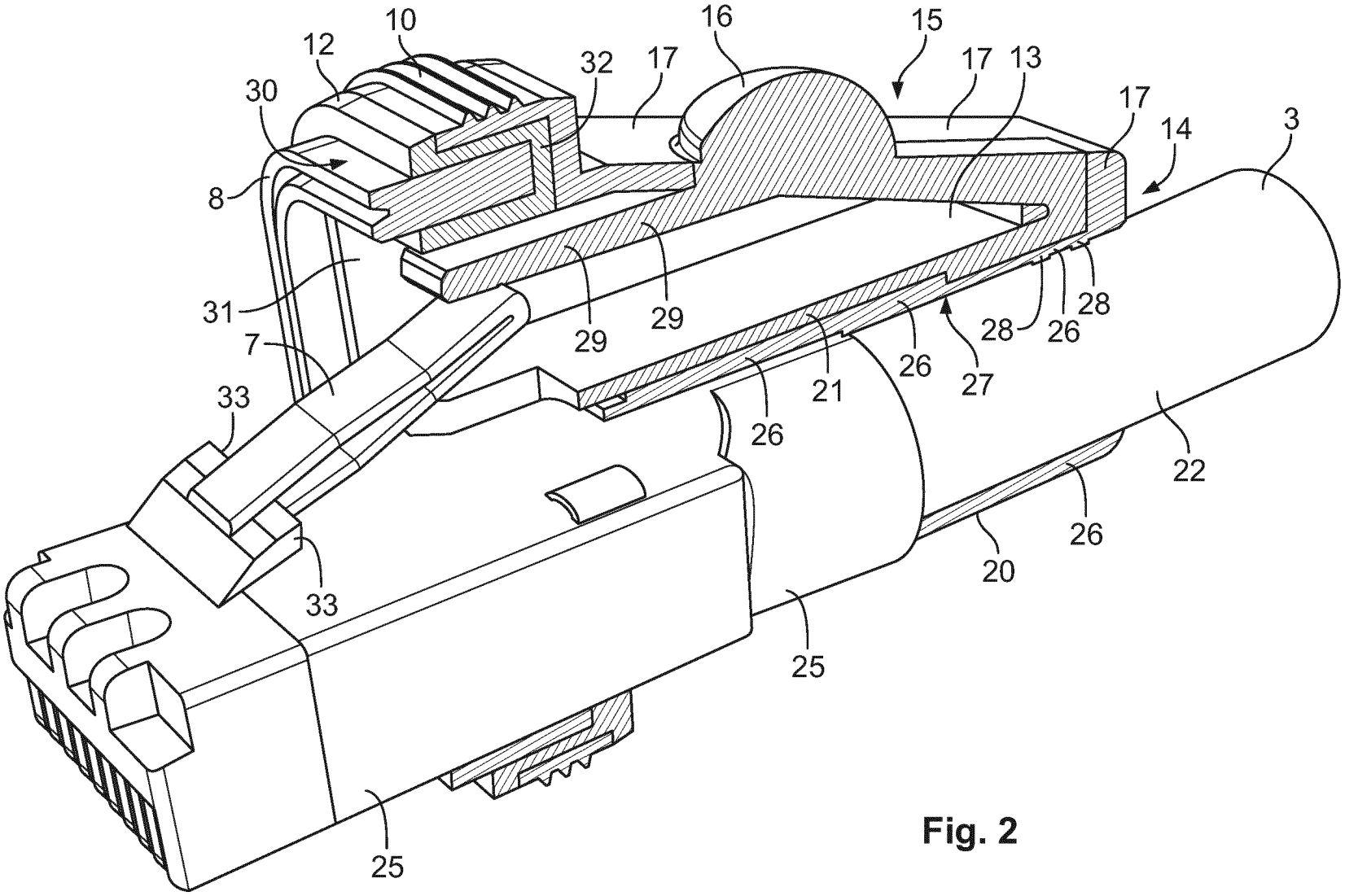
FIG. 2 is a partially sectioned illustration of the connector having a housing.

FIG. 2 is a perspective partial cross-section through the housing 1. The housing 1 has a housing base 20 and a housing plate 21 with spacing therefrom. The cable 3 is guided through the rear-side, circular second opening 22 between the housing base 20 and the housing plate 21. The housing base 20 and the housing plate 21 are connected to each other by means of side walls 23, 24 (FIG. 1) of the housing 1. The cable 3 is connected to the connector 2, an electrical shield of the cable 3 being connected in an electrically conductive manner to an electrically conductive connector housing 25 of the connector 2. The housing plate 21 has at a lower side a second layer 26 which is produced from the resilient and electrically conductive material and which is connected to the layer 17 in an electrically conductive manner. For example, the second layer 26 and the layer 17 may be constructed in one piece. Depending on the embodiment selected, an upper side of the housing base 20 may also have a second layer 26. Preferably, an inner face of the housing 1 which is formed by the side walls 23, 24, the housing base 20 and the housing plate 21, has a second layer 26. The second layer 26 is constructed particularly in the region of the second opening 22 in an annular manner. The entire inner face 27 is preferably covered by the second layer 26. The second layer 26 of the inner face is also connected to the layer 17 and is in particular constructed in one piece with the layer 17.

The second layer 26 abuts a portion of the connector housing 25 and is consequently connected to the shield of the cable 3 in an electrically conductive manner. Depending on the embodiment selected, the shield of the cable 3 may also be exposed and directly adjoin the second layer 26. The second layer 26 surrounds the cable 3 in an annular manner in the region of the second opening 22 so that the second opening 22 is sealed with respect to the infiltration of dust or moisture. In the illustrated embodiment, the second layer 26 has two sealing lips 28 which are arranged in a parallel manner and which are constructed in an annular manner and which improve the sealing with respect to the cable 3. Depending on the embodiment selected, the sealing lips 28 may also be dispensed with.

The curved engaging member 7 of the connector 2 extends to a curved redirection member 29 of the housing 1 that is connected to the actuation element 16.

The first edge region 8 is formed in a third peripheral groove 30 which is formed between a peripheral inner edge 31 and the housing ring 12. The inner edge 31 and the housing ring 12 are connected to each other by means of a connection face 32 of the housing 1.

The housing 1 is constructed in a flexible manner in the region of the actuation element 16 so that, by the actuation element 16 being pressed down, the curved actuation member 29 is also pressed downwards and the curved engaging member 7 is also thereby pivoted downwards into a release position. The curved engaging member 7 has locking faces 33 which face the housing 1.

Figure 3:
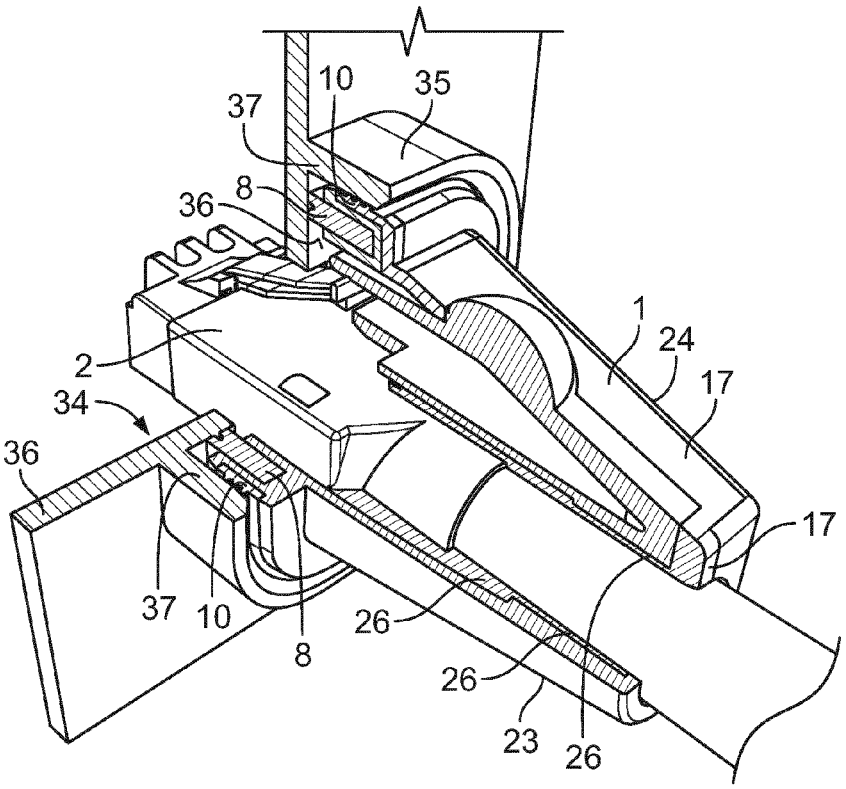
FIG. 3 is a partially sectioned illustration of an assembled connector.

FIG. 3 is a partially sectioned view of an assembled connector 2. The connector 2 is connected to a contact socket which is not illustrated. The connector 2 is guided through an assembly opening 34 of another housing 35, the connector 2 being locked by the engaging faces 33 against being pulled back out of the assembly opening 34. The other housing 35 is illustrated as a partial cross-section. The other housing 35 has a planar first abutment face 36 which the first edge region 8 of the housing 1 abuts in a sealing manner. In the illustrated embodiment, the other housing 35 further has an annularly extending second abutment face 37 which receives a part-portion of the housing 1. The second abutment face 37 is arranged substantially perpendicularly relative to the first abutment face 36. The second edge region 10 of the housing 1 is associated with the second abutment face 37, the second edge region 10 of the housing 1 being in abutment with the second abutment face 37 in a sealing manner.

Figure 4:
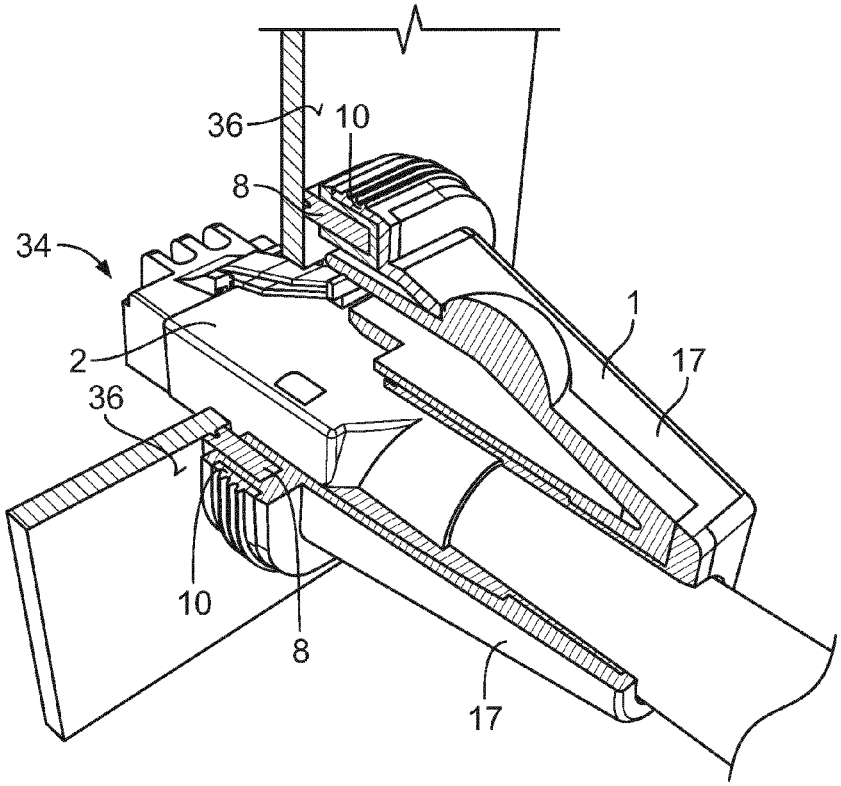
FIG. 4 is a partially sectioned illustration of another embodiment of an assembled connector.

Depending on the embodiment selected, the second abutment face 17 may also be dispensed with, as illustrated in FIG. 4.

Depending on the embodiment selected, the second layer 26 and the housing 1 and the first and the second edge region 8, 10 may be constructed in two parts and be connected by means of a catch type or plug type connection.

In another embodiment, the resilient material, in particular in the form of the viscoelastic material, can be brought into an end form by means of compression when the housing is assembled. In particular, owing to the compression of the resilient material, it is possible to form a seal by means of the resilient material between the cable 3 and the housing 2. The shape of the layer 26, when the connector 2 is assembled by introducing the connector 2 with the cable through the opening 4, can be formed by compressing the layer 26 with the cable 3 and the connector 2.

Depending on the desired conductivity, the electrically conductive and resilient material has, for example, a proportion of from 20 to 30% of the conductive material and/or from 20 to 30% of the conductive particles. The production of the electrically conductive material is carried out by means of stirring and mixing the electrically conductive material or the electrically conductive particles in a fluid resilient material. After the stirring, the required forms are produced and hardened to form a purely resilient material and/or a viscoelastic material.

The resilient material may be comprised of any one of a number of known resilient materials. The resilient material may, for example, be produced from an oil-containing thermoplastic gel or from a dry silica gel, in particular a dry thermally hardened plastics material, in particular silica gel. Furthermore, the resilient material may be produced from a polyurethane gel. A dry silica gel dispenses with a separate solvent or a separate softening agent. The resilient and electrically conductive material may have a hardness between 26 and 53 Shore 000 hardness. In addition, the resilient, electrically conductive material may have a resilience of from 4 to 60% between the original size and a compressed size.

The viscoelastic material may have a hardness of from 150 to 500 grammes.

Figure 5:
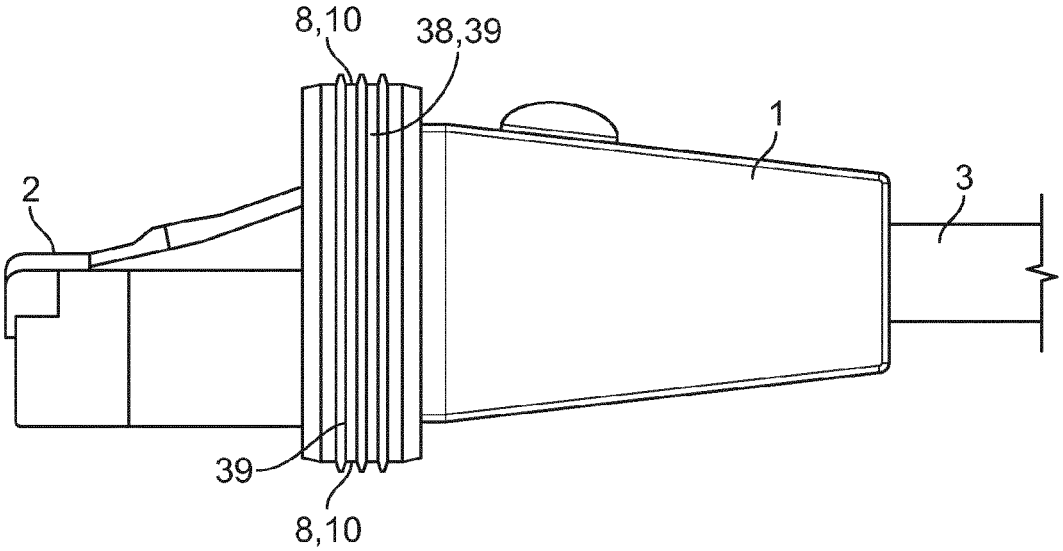
FIG. 5 is a schematic side view of another embodiment.

FIG. 5 is a schematic side view of a housing 1 having an integral radial and axial seal comprising the first and second edge region 8, 10. In the first and second edge region 8, 10, an electrically conductive particle 38 and a particle 39 which is provided with an electrically conductive layer 40 are schematically illustrated. For example, the particle 39 may comprise an electrically insulating material, for example, a ceramic or mineral material, which is provided with an electrically conductive layer 40, for example, a metal layer. It is possible to use, for example, silver and/or gold and/or palladium as the metal.

Figure 6:
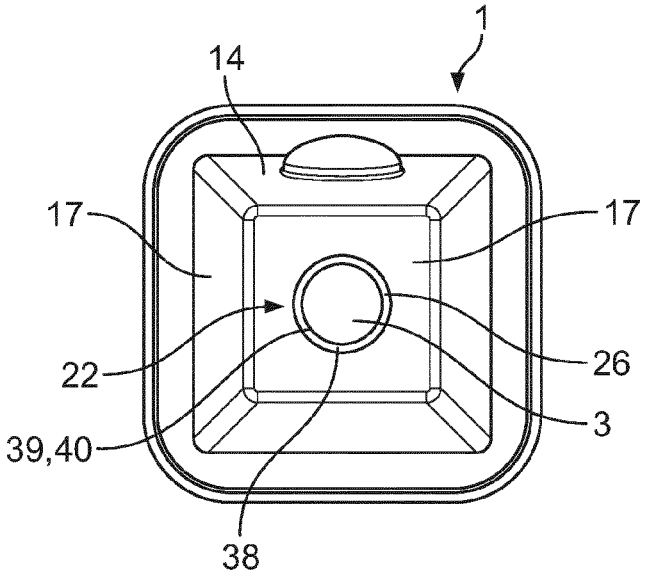
FIG. 6 is a view of the rear side of the housing.

FIG. 6 is a schematic illustration of the rear side 14 of the housing 1 having a second layer 26 which radially surrounds the cable 3 and which seals the second opening 22 with respect to the cable. The second layer 26 is in contact with the layer 17 which is also formed on the rear side 14.

Silica gels such as, for example, silicone rubbers are masses which can be converted into the resilient state and which contain poly(organo)siloxanes which have groups which are accessible for cross-linking reactions. These include primarily hydrogen atoms, hydroxy groups and vinyl groups which are located at the chain ends but which may also be incorporated in the chain. Silicone rubbers contain reinforcing materials and filler materials whose type and quantity significantly influence the mechanical and chemical behaviour of the silicone elastomers produced by the cross-linking.

A differentiation is made in accordance with the necessary cross-linking temperature between cold cross-linking (RTV) and hot cross-linking (HTV) silicone rubbers (RTV=cross-linking at ambient temperature, HTV=cross-linking at high temperature). HTV silicone rubbers are plastically deformable materials. They very often contain organic peroxides for the cross-linking. The elastomers which are produced from them owing to the cross-linking at high temperature are heat-resistant products which are resilient between −40 and 250° C. and which are used, for example, as high-quality sealing, damping, electrical insulation components, cable coatings and the like.

Another cross-linking mechanism involves an addition, which is generally catalysed by precious metal compounds, of Si—H— groups to silicon-bound vinyl groups, which are both incorporated in the polymer chains or at the end thereof. The silicone rubber components which, in contrast to the HTV rubbers described above, have a lower viscosity and can consequently be pumped, are mixed and metered with suitable mixing and metering machines and usually processed in injection moulding machines. This technology enables high cycle rates owing to the short duration of the cross-linking of the rubbers.

In the case of RTV silicone rubbers, it is possible to differentiate between single and two-component systems. The first group (RTV 1) cross-links at ambient temperature under the influence of air humidity, the cross-linking being carried out by means of condensation of SiOH groups, with Si—O bonds being formed. The Si—OH groups are formed by means of hydrolysis of SiX groups of a species resulting in an intermediate manner from a polymer having terminal OH groups and a so-called cross-linking agent R—SiX3 (X=—O—CO—CH3, —NHR). In the case of two-component rubbers (RTV-2), for example, admixtures of silicic acid esters (for example, ethyl silicate) and organotin compounds are used as cross-linking agents, the formation of an Si—O—Si bridge from Si—OR and Si—OH being carried out by means of alcohol separation as a cross-linking reaction.

The invention claimed is:

1. A housing comprising a main body and a seal, the main body being formed of an insulating material and the seal being formed from a resilient material, wherein the resilient material is electrically conductive, wherein the main body is provided with an opening for introducing an electrical cable, and wherein the seal surrounds the opening and is provided for sealing the introduction of the electrical cable and for electrically contacting an electrical shield of the cable, wherein the housing is a connector housing, in particular the housing for an RJ-45 connector, wherein the housing partially comprises the same material as the seal, with a portion of the housing in particular being constructed in one piece with the seal.

2. The housing according to claim 1, wherein the resilient material is constructed in a purely resilient and/or viscoelastic manner.

3. The housing according to claim 1, wherein the resilient, electrically conductive material has a silica gel.

4. The housing according to claim 1, wherein the seal is produced from an admixture of a resilient material and an electrically conductive material.

5. The housing according to claim 4, wherein the electrically conductive material has carbon black and/or graphite.

6. The housing according to claim 1, wherein the seal is produced from an admixture of a resilient material and electrically conductive particles.

7. The housing according to claim 6, wherein the electrically conductive particles are constructed in the form of metal particles, electrically conductive nanoparticles and/or graphite particles, in particular as graphite tubes.

8. The housing according to claim 6, wherein an electrically conductive particle is constructed in the form of a particle having an electrically conductive layer.

9. The housing according to claim 1, wherein the housing is connected to another housing, the seal being in abutment against a receiving member of the other housing in a sealing manner, in particular being in abutment in an axially and/or radially sealing manner.

10. The housing according to claim 1, wherein the housing partially comprises an electrically conductive material.

11. The housing according to claim 1, wherein the seal is arranged between the cable and the housing and is brought into an end form when the housing is assembled by means of compression of the resilient material.

* * * * *